United States Patent [19]

Roberts

[11] Patent Number: 4,681,042

[45] Date of Patent: Jul. 21, 1987

[54] ADJUSTABLE TABLE TOP ASSEMBLY

[76] Inventor: Fred E. Roberts, 1322 Fourth Ave., Conway, S.C. 29526

[21] Appl. No.: 236,637

[22] Filed: Feb. 20, 1981

[51] Int. Cl.[4] ..... A47F 5/12

[52] U.S. Cl. ..... 108/6; 108/8

[58] Field of Search ..... 108/6, 8, 2; 248/408

[56] References Cited

U.S. PATENT DOCUMENTS

| | | | |
|---|---|---|---|
| 1,138,265 | 5/1915 | Vosburgh . | |
| 2,404,949 | 7/1946 | DeLisle | 108/6 |
| 2,452,216 | 10/1948 | Yarber . | |
| 3,052,057 | 9/1962 | May et al. . | |
| 3,140,559 | 7/1964 | Grow et al. | 108/6 |
| 3,358,620 | 12/1967 | Parigi . | |
| 3,543,282 | 11/1970 | Sautereau | 108/6 X |

FOREIGN PATENT DOCUMENTS

| | | | |
|---|---|---|---|
| 1414035 | 9/1965 | France | 108/6 |

*Primary Examiner*—Francis K. Zugel
*Attorney, Agent, or Firm*—Bailey & Hardaway

[57] ABSTRACT

It has been found that an adjustable table top assembly for a drafting table and the like may be provided utilizing braking elements comprising an elongated member pivoted intermediate its ends to be pulled downwardly by a foot pedal against the force of a spring for releasably engaging a bracket support carried by the pivoted table top.

1 Claim, 2 Drawing Figures

ADJUSTABLE TABLE TOP ASSEMBLY

BACKGROUND OF THE INVENTION

Efforts have been made to provide a tiltable adjustable table top for use on drafting tables and the like wherein the user may position the pivoted planar table top in an adjusted tilted position. U.S. Pat. No. 1,138,265 discloses a table having a tiltable top operated through the use of a foot pedal and a pawl arrangement which operates with a movable rack. U.S. Pat. No. 2,452,716 discloses an adjustable table top having brackets in the form of sectors at each end which may be adjustably locked in place by a toggle operated mechanism controlled by a foot pedal. The state of the art is further illustrated by U.S. Pat. Nos. 3,052,057 and 3,358,620.

Accordingly, it is an important object of the present invention to provide an effective braking apparatus which may be operated by a foot pedal for adjustably positioning the tilted position of the drafting table and the like which may be of simple construction capable of positive operation.

Another important object of the invention is to provide a device for adjustably positioning a table top which may be easily controlled by the user with a minimum of effort and which will provide an effective locking operation.

BRIEF DESCRIPTION OF THE INVENTION

It has been found that a braking apparatus may be provided for adjustably positioning the top of a drafting table and the like utilizing a depending bracket carried by the table top engagable by a locking end portion of an elongated link which may be released through operation of a foot pedal against the force of a spring normally biasing the member into locking position with the bracket carried by the table top.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
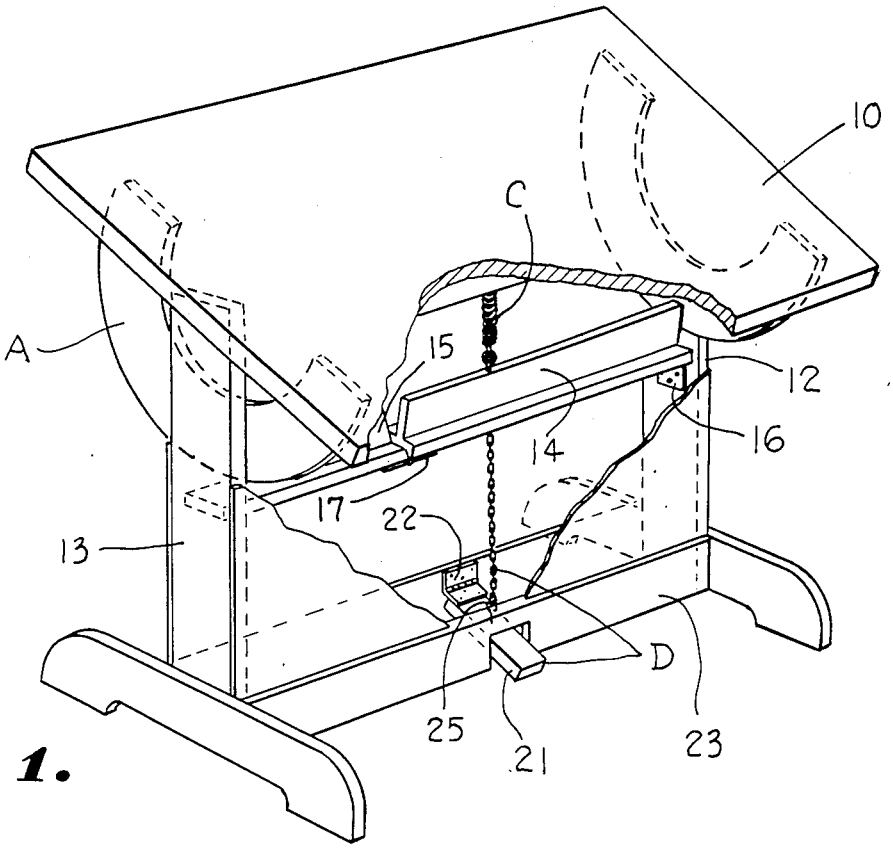
FIG. 1 is a perspective view looking toward the rear of a drafting table having an adjustment mechanism constructed in accordance with the present invention utilizing a foot pedal to control stop means for engaging depending segments carried by the table top.

The drawing illustrates a drafting table and the like having a pivotally adjustable flat top carried by an upright support. A downwardly extending bracket A is carried by the top on opposite sides thereof. An elongated member B is carried for pivotal movement beneath the top into position wherein an end portion thereof is in abutting relation to the downwardly extending bracket immobilizing the top against pivotal movement. A spring C is connected to the elongated member maintaining same in position immobilizing the top. Foot pedal operated means D are provided which when pressed, overcomes the force of the spring releasing the top for pivotal adjustment. The elongated member B includes a pair of links aligned in end-to-end relation substantially horizontally and pivoted intermediate opposed end portions. An arcuate bracket A is positioned opposite each end portion for engagement thereby to immobilize the top in a desired fixed adjusted position.

The invention is illustrated as being utilized in connection with a drafting table, although other work tables and the like may be equally well suited to the application of the invention. The drafting table is illustrated as having a top 10 which is generally planar and is pivoted as by hinges 11 which are carried by spaced upright supports 12 and 13. The table top has a depending bracket in the form of arcuate segments A carried adjacent each side of the table top and depending therefrom.

The elongated member B is illustrated as comprised of spaced, straight segments 14 and 15 each of which has a remote end hinged as at 16 to respective upright legs 12 and 13. The segments 14 and 15 are hinged as at 17 intermediate their ends, and a remote portion of each of the respective segments carries a rubber strip 18 which may be tacked closed or otherwise connected for adding friction as desired to increase the braking action of such ends of the respective segments 14 and 15 against the inner surfaces of the depending arcuate segments A carried beneath the table top 10.

It will be observed that the adjacent ends of the segments 14 and 15 are cut back at an angle as at **14*a* and 15*a*** to provide for pivotal downward movement of the straight segments against the force of the coil spring C.

The coil spring C is illustrated as being attached by means of a threaded eyelet 19 to an intermediate portion of the elongated member B on one end and a similar fastener 20 secures the spring on the other end to a fixed element carried by the table top.

The foot pedal operated means D includes a pivoted foot pedal 21 which is pivotally connected as by a hinge 22 to a lower horizontal support member 23 which brakes the upright supports 12 and 13. A chain 24 is connected by a suitable eyelet 25 to an intermediate portion of the foot pedal on one end for securement to a hook 26 which has threadable connection with a lower member forming a part of the elongated member B.

Figure 2:
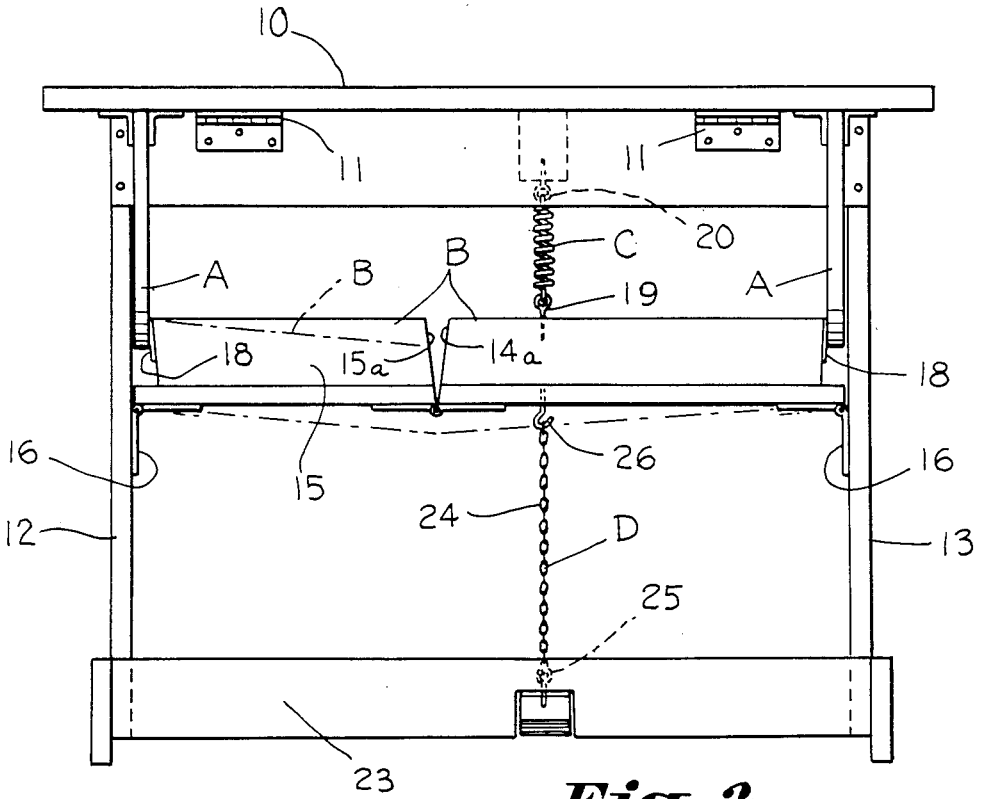
FIG. 2 is a front elevation further illustrating the operating mechanism controlled by the pivoted foot pedal.

It is thus seen that a braking mechanism incorporated in an assembly for adjustably positioning a drafting table top and the like has been provided. The assembly utilizes an elongated member which is comprised of a pair of centrally pivoted aligned, straight segments which may be depressed to release the arcuate bracket depending from the table top against the force of a spring which normally maintains the table top in a desired adjusted blocked position, as illustrated in broken lines in FIG. 2. Since the parts are of simple construction, they may be readily operated by a conveniently depressed foot pedal as opposed to various threaded stops which were often employed in practical operation in the past. The drafting operation requires many adjustments of the table top and in order to facilitate and simplify and ease the drafting operation, such is accomplished by the present invention illustrated and described herein.

While a preferred embodiment of the invention has been described using specific terms, such description is for illustrative purposes only, and it is to be understood that changes and variations may be made without departing from the spirit or scope of the following claims.

What is claimed is:

1. In a drafting table and the like, means adjusting the angular position of a pivotally adjustable flat top carried by an upright support comprising:

a pair of spaced oppositely disposed downwardly extending arcuate brackets carried by said top;

an elongated member carried for pivotal movement beneath said top into position wherein end portions thereof are in abutting relation to respective downwardly extending brackets immobilizing said top against pivotal movement;

said elongated member including a pair of links aligned in end-to-end relation substantially horizontally and pivoted intermediate opposed portions;

a spring connected to said elongated member maintaining same in said position immobilizing said top; and foot pedal operated means which when pressed overcomes the force of the spring releasing said top for pivotal adjustment.

* * * * *